US005224453A

United States Patent [19]

Bederna et al.

[11] Patent Number: 5,224,453

[45] Date of Patent: Jul. 6, 1993

[54] SYSTEM FOR OPEN-LOOP CONTROLLING AND/OR CLOSED-LOOP CONTROLLING AN INTERNAL COMBUSTION ENGINE

[75] Inventors: Frank Bederna, Markgröningen; Alois Hils, Bretten-Neibsheim, both of Fed. Rep. of Germany

[73] Assignee: Robert Bosch GmbH, Stuttgart, Fed. Rep. of Germany

[21] Appl. No.: 768,728

[22] PCT Filed: Jan. 19, 1991

[86] PCT No.: PCT/DE91/00042

§ 371 Date: Oct. 10, 1991

§ 102(e) Date: Oct. 10, 1991

[87] PCT Pub. No.: WO91/12423

PCT Pub. Date: Aug. 22, 1991

[30] Foreign Application Priority Data

Feb. 10, 1990 [DE] Fed. Rep. of Germany ..... 4004083

[51] Int. Cl.[5] ..... F02M 51/00

[52] U.S. Cl. ..... 123/479; 73/118.1

[58] Field of Search ..... 123/479, 440, 489; 364/424.03, 431.07

[56] References Cited

U.S. PATENT DOCUMENTS 4,928,242 5/1990 Suzuki ..... 364/424.03
4,933,863 6/1990 Okano et al. ..... 364/431.07
5,048,491 9/1991 Haiki ..... 123/479
5,054,452 10/1991 Denz ..... 123/479
5,080,072 1/1992 Hosokai et al. ..... 123/479
5,090,387 2/1992 Mayor et al. ..... 123/479

FOREIGN PATENT DOCUMENTS 3621937 1/1988 Fed. Rep. of Germany ..... 123/478

*Primary Examiner*—Raymond A. Nelli
*Attorney, Agent, or Firm*—Walter Ottesen

[57] ABSTRACT

A system for the open-loop and/or closed-loop control of an internal combustion engine is suggested at least dependent upon signal values which represent the position at least of one element influencing the power of the internal combustion engine and which are determined by a measuring device for detecting this position. This measuring device includes several sensors which each detect the position of the same element. On the basis of the signal values generated by the sensors, a first malfunction detection is carried out as to whether the signal values with respect to each other lie in a first pregiven value range. A second malfunction check takes place especially in the idle or near-idle region of the position of the particular element as to whether the signal values individually and/or to each other lie in a pregiven second value region. In this connection, the second malfunction check is less sensitive than the first.

11 Claims, 3 Drawing Sheets

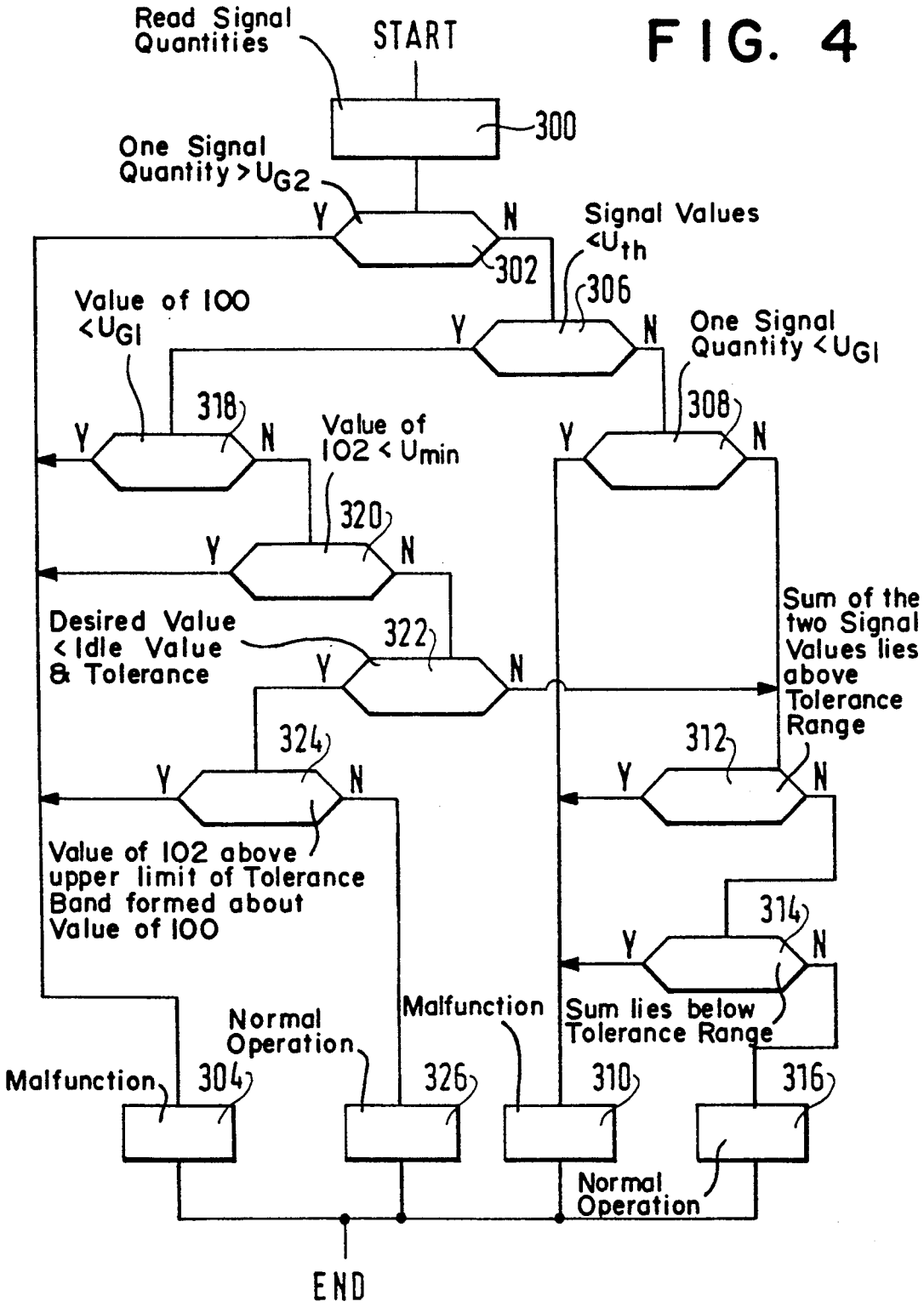
FIG. 4
Read Signal Quantities
START
300
One Signal Quantity > $U_{G2}$
Y
N
302
Signal Values < $U_{th}$
306
Value of 100 < $U_{GI}$
One Signal Quantity < $U_{GI}$
318
308
Value of 102 < $U_{min}$
320
Desired Value < Idle Value & Tolerance
322
Sum of the two Signal Values lies above Tolerance Range
324
312
Value of 102 above upper limit of Tolerance Band formed about Value of 100
314
Sum lies below Tolerance Range
Malfunction
304
Normal Operation
326
Malfunction
310
316
Normal Operation
END

SYSTEM FOR OPEN-LOOP CONTROLLING AND/OR CLOSED-LOOP CONTROLLING AN INTERNAL COMBUSTION ENGINE

FIELD OF THE INVENTION

The invention relates to a system for the open-loop control and/or closed-loop control of an internal combustion engine.

BACKGROUND OF THE INVENTION

One such system is known from U.S. patent application Ser. No. 165,276, filed on Feb. 5, 1987. The system described there for the open-loop control and/or closed-loop control of an internal combustion engine includes at least one measuring device for detecting an operating parameter of the internal combustion engine and/or of the motor vehicle in dependence upon which the internal combustion engine is open-loop controlled and/or closed-loop controlled. This operating parameter is especially the position of a power-determining element of an electronic accelerator pedal system such as a power actuator and/or an operator element actuable by the driver. A detection of a malfunction for the measuring device takes place starting from the signal values representing the operating parameter and supplied by the measuring device. The malfunction detection takes place by comparisons of these signal values to pregiven limit values in the form of a signal range check.

Difficulties then occur when the sensor utilized to detect an operating parameter of the engine and/or of the motor vehicle displays component ranges in its signal range which are characterized by a signal transmission or signal generation which is incomplete and adversely affected. This occurs for example because of contamination or when utilizing potentiometers since there poorly-conductive regions are formed on the resistance track because of abrasion in the component regions of its movement range and especially at the change-of direction points. These regions lead to a large contact resistance between the resistance track and the slider tap and therefore, on the one hand, lead to a false operating parameter signal value while, on the other hand, lead to a fault announcement in the monitoring system known from the state of the art and therefore to a failure of the system equipped with the measuring device.

The invention therefore has the object of providing measures which ensure an overall operational reliability and availability of the open-loop control system and/or closed-loop control system of an internal combustion engine. This is obtained in that a testing method is utilized for checking malfunctions of the measuring device detecting the operating parameter with the testing method being configured to be less sensitive within the pregiven component ranges than outside of these component ranges.

In a further embodiment, measuring devices can be provided which comprise several sensors which detect respective operating parameters of the internal combustion engine and/or of the motor vehicle especially the position of a power-determining element corresponding to the engine and/or vehicle. And, on the basis of the signal values generated by the sensors, a first malfunction check is carried out as to whether the signal values lie in a first pregiven value range and, in pregiven component ranges burdened with the above-mentioned problems (for potentiometers especially in idle regions or regions close to idle of the position of the particular element), a second malfunction check takes place as to whether the signal values individually and/or with respect to each other lie in a pregiven second value range.

A monitoring arrangement for an electronically controlled throttle flap in a motor vehicle is known from U.S. Pat. No. 4,603,675 with a measuring device being connected to the accelerator pedal of an electronic accelerator pedal system. In one of the embodiments, the measuring device comprises a position transducer potentiometer and a monitoring potentiometer. The position signal supplied by the position-transducer potentiometer is compared in a logic unit to threshold values determined from the signal of the monitoring potentiometer and the function of the measuring device is checked on the basis of the magnitude of the signal of the position-transducer potentiometer compared to the threshold values. This procedure likewise shows the above-mentioned disadvantages.

SUMMARY OF THE INVENTION

An advantage of the procedure according to the invention is seen in that a testing method is utilized which, in component regions, is less sensitively configured. The component regions are characterized by adversely affected incomplete signal transfer or generation, for example, because of a contact resistance between the resistance track and the slider tap of a potentiometer with the contact resistance being increased because of abrasion. In this way, actually occurring malfunctions of the sensor are detected on the one hand and a switch-off of the entire system because of the above-explained apparent malfunction is however effectively avoided. The procedure according to the invention ensures substantial operational reliability and availability of a system for open-loop and/or closed-loop control of an internal combustion engine. This is the case because for a measuring device comprising several sensors, by means of a first malfunction check, a detection is possible of shunts having parasitic resistances to the supply voltage poles as well as between the signal lines of the sensors as well as of non-linearities of the sensor characteristics and of interruptions of the signal lines with parasitic resistances to the supply voltage poles with this first malfunction check determining as to whether the signal values generated by the sensors lie next to each other in a pregiven first value range. A second less sensitive malfunction check in pregiven component ranges as to whether the signal values of the sensors lie individually and/or next to each other in a pregiven second value range further makes possible that the above-mentioned faults are also detectable in these component ranges and a shut off of the system based on the above-explained apparent malfunction can be avoided and the availability and operational reliability of the system is improved.

Further advantages of the invention will become apparent from the embodiments described below in combination with the dependent claims.

BRIEF DESCRIPTION OF THE DRAWINGS

The invention will now be explained with reference to the embodiments shown in the drawing. In this connection.

DESCRIPTION OF THE PREFERRED EMBODIMENTS OF THE INVENTION

Figure 1:
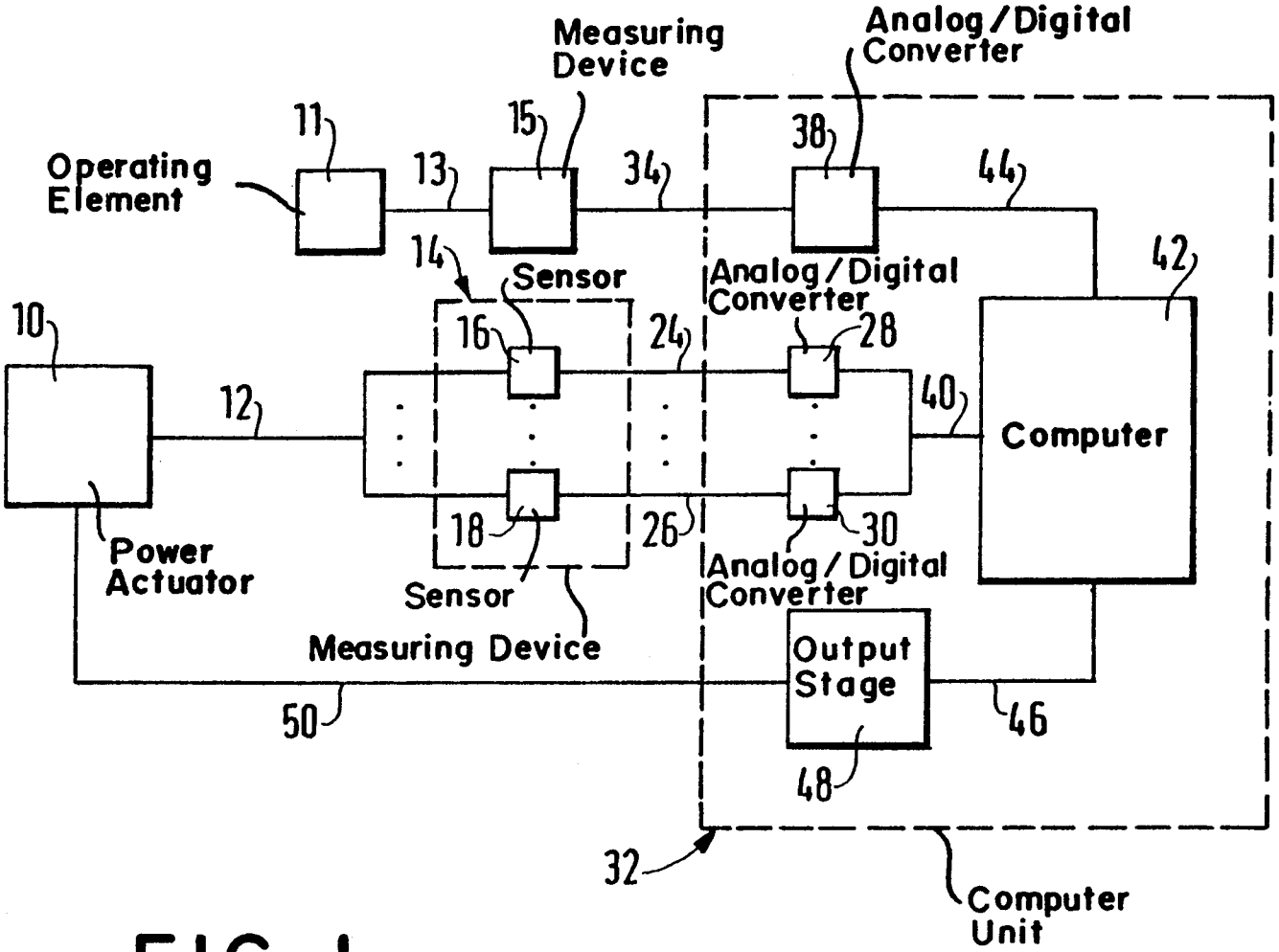
FIG. 1 shows a circuit block diagram of a system equipped with a measuring device comprising several sensors with the system being exemplary of an electronic accelerator pedal.

In FIG. 1, a power actuator 10 of an internal combustion engine (not shown) is illustrated with the actuator 10 being, for example, a throttle flap for influencing the air flow to the internal combustion engine or a control rod for controlling fuel quantity metered to the internal combustion engine. In addition, 11 identifies an operator element actuable by the driver such as an accelerator pedal of an electronic accelerator pedal system. The power actuator 10 and/or the operator element 11 are connected via connections 12 and 13 to measuring devices 14 and 15, respectively, including several sensors. The measuring devices 14 and 15 can be configured identically. To provide a clear view, only the measuring device 14 corresponding to the power actuator 10 is shown in FIG. 1 so that the following statements referring to the measuring unit 14 can be applied in an analog manner to the measuring device 15. The measuring devices 14 and 15 generate signal quantities in correspondence to the number of sensors with the signal quantities representing the position of elements 10 and 11 corresponding thereto.

The measuring device 14 includes several sensors 16 to 18 for detecting the position of the element assigned thereto. In a preferred embodiment, the sensors 16 to 18 are potentiometers. The mechanical connection 12 acts on the sensors 16 to 18 in such a manner that a position change of the corresponding element 10 leads to a corresponding change of the output signal quantities of the sensors so that each sensor generates a signal quantity representing the position of the element corresponding thereto.

If the sensors are configured as potentiometers, for example, the mechanical connection 12 is connected to the movable slider taps of the potentiometers. The position signal quantity is taken off in this case at the slider taps.

The signal lines 24 to 26 connect the sensors to the analog-to-digital converters 28 to 30, respectively, which are a part of the computer unit 32. The measuring unit 14 is connected via the signal lines 24 to 26 to the computer unit 32.

In addition to the analog-to-digital converters 28 to 30, the computer unit 32 includes a further group of analog-to-digital converters 38 which are connected via the signal lines 34 to the measuring device 15. For the sake of clarity, a detailed illustration of these elements is omitted. Their configuration and operation can be taken from the description in connection with the measuring device 14.

The analog-to-digital converters 28 to 30 are connected via a connecting line 40 to a computer 42 to which the line 44 is also led and which connects the computer 42 to the analog-to-digital converters 38. The output line 46 of the computer 42 leads via an output stage 48 to an output line 50 of the computer unit 32 which connects the computer unit 32 to the power actuator 10 of the internal combustion engine.

The function of the arrangement of FIG. 1 is explained in the following. The measuring device 14 supplies via the signal lines 24 to 26 a signal of the position of element 10 to the computer unit 32 which is transmitted via the connection 12 to the sensors 16 to 18. In the computer 42 of the computer unit 32, the signal quantities supplied via the line 40 to the computer 42 are processed with the signal quantities being converted into digital quantities from analog quantities by means of the analog-to-digital converters 28 to 30.

In one embodiment, the signal quantity of the sensor 16 is compared in the computer 42 to the desired value of the position of the operator element with the desired value being supplied to the computer via the line 44. The signal quantity of the sensor 16 represents the power actuator position and therewith the actual value of a power control loop comprising the internal combustion engine and computer unit 32. In dependence upon this comparison result, the power actuator 10 is influenced via the output lines 46, the output stage 48 and the output lines 50 in such a manner that the difference between the desired and actual values is reduced. In this embodiment, the signal quantities of the additional sensors serve simply to monitor the function of the sensor 16.

Furthermore, it is possible that a mean value or a minimum value from the signal quantities generated by the sensors 16 to 18 is used for closed-loop controlling the position of the power actuator 10 with at least one of the signal quantities of one of the sensors serving to monitor the function of the other sensor or sensors.

Furthermore, the procedure according to the invention for checking malfunction is carried out in the computer unit 32 on the basis of the signal quantities of the sensors 16 to 18.

In addition to the function shown in FIG. 1, the computer unit 32 carries out additional functions such as ignition time point determination, fuel metering and/or idle closed-loop control.

Figure 2:
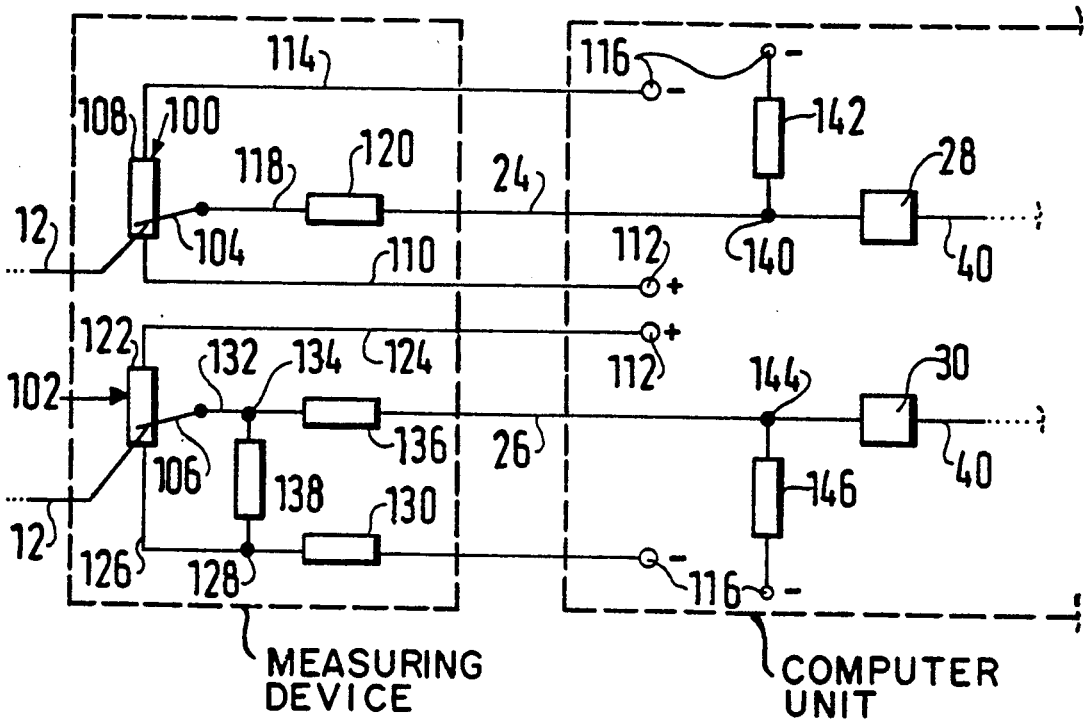
FIG. 2 shows a preferred embodiment of the measuring device for the example of a double potentiometer; whereas, in FIGS. 3 and 4, the procedure of the invention is made clear in the context of an example of a characteristic diagram and a flowchart.

A preferred embodiment of the measuring device 14 and/or 15 is shown in FIG. 2 as a so-called double potentiometer. FIG. 2 shows the measuring device 14 or 15 as well as the computer unit 32 having inputs and outputs assigned as shown in FIG. 1. The measuring device includes two sensors 100 and 102 configured as potentiometers having slider taps 104 and 106, respectively, which are connected to mechanical connections 12 and 13. The two slider taps 104 and 106 change their respective positions parallel to each other in the same direction in dependence upon the position change of the element which acts via the mechanical connection on the slider taps.

The resistance track 108 of the sensor 100 is connected via a connecting line 110 to the positive pole 112 of the supply voltage; whereas, at the other end of the resistance track 108 of the sensor 100, a second line 114 leads to the negative pole 116 of the supply voltage. In this connection, in the configuration of the sensor 100, the position of the slider tap 104 in the proximity of the positive terminal of the supply voltage corresponds, as shown in FIG. 2, to an idle position of the corresponding element. The slider tap 104 is connected via the signal line 118 and the resistor 120 to the signal line 24 or, in the case of the measuring device 15, to one of the lines 34 which connect the measuring units to the computer unit 32.

The resistance track 122 of the sensor 102 is connected via the connecting line 124 to the positive pole 112 of the supply voltage; whereas, at the other end of the resistance track 122 of the sensor 102, a second line 126 is led via the connecting node 128 and the resistor 130 to the negative pole 116 of the supply voltage. The slider tap 106 of the sensor 102 is connected to a signal line 132 which leads via the connecting node 134 and the resistor 136 to the signal line 26 or, in the case of measuring device 15, to one of the lines 34 which connects the measuring devices to the computer unit 32. A further resistor 138 lies between the two connecting nodes 134 and 128. In contrast to sensor 100, the idle position of the sensor 102 is disposed in the proximity of the negative terminal of the supply voltage. In this configuration, the two potentiometers are electrically opposing; that is, with a position change, the signal quantities of the two sensors change in mutually opposite directions. The procedure according to the invention however is also applicable to electric potentiometers running in the same direction.

In the computer unit 32, the signal line 24 leads to a connecting node 140. A resistor 142 is connected to the connecting node 140 and to the negative pole 116 of the supply voltage. In addition, the signal line 24 leads via this connecting node 140 to the analog-to-digital converter 28 or to one of the analog-to-digital converters 38. In an analog manner, the signal line 26 leads via the connecting node 144 to the analog-to-digital converter 30 and a resistor 146 is connected to the connecting node 144 and the negative pole 116 of the supply voltage. Corresponding to FIG. 1, the outputs of the two analog-to-digital converters 28 and 30 are connected to a connecting line 40 which connects the converters to the computer 42.

The operation of the arrangement of FIG. 2 takes place in correspondence to that of FIG. 1.

In the case of increased resistance between resistance track and slider tap, a pregiven minimum signal value is impressed on the signal line 132 and 26 by means of the voltage divider of the resistors 130 and 138 in combination with the resistor 146 representing the input circuit of the computer unit 32. The minimum signal value does not occur in the case of an interrupted signal line 132 or 26 or an interrupted ground line 126. In this way, and as will be explained below, it is made possible to distinguish between an interrupted line and an increased contact resistance.

The input circuit (resistor 146) of the computer unit 32 corresponding to the sensor 102 is configured in such a manner that, for example, for an interrupted signal line, a signal quantity is conducted to the computer unit which corresponds to an idle position of the corresponding element, especially the value 0.

Figure 3:
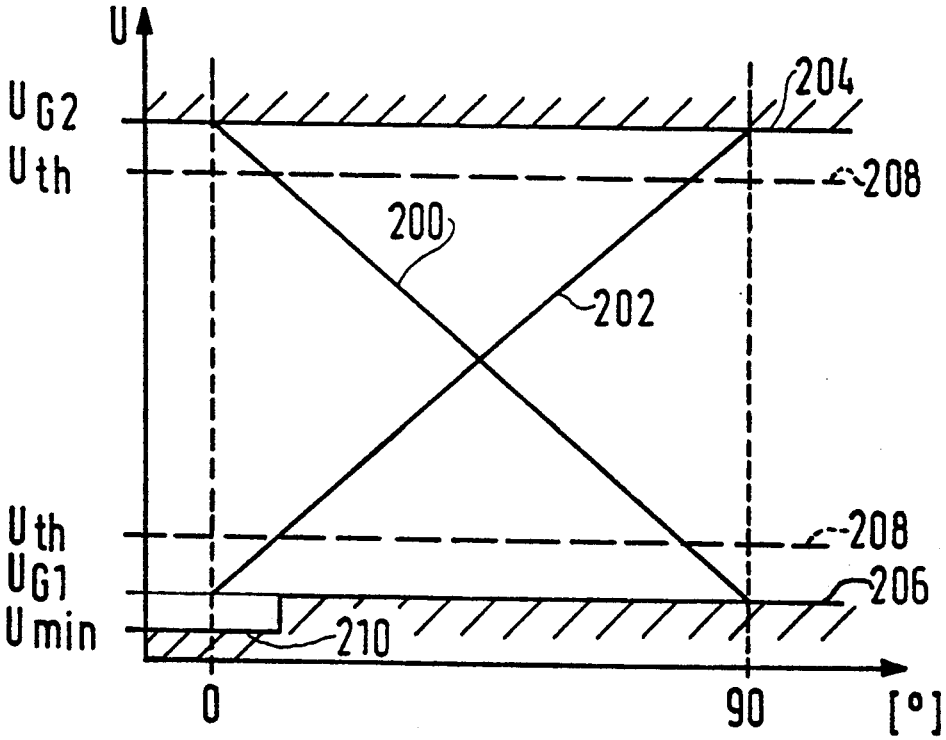

The above-explained subject matter is made clear with the example of the characteristic diagram of FIG. 3. There, the signal quantities U of the sensor are indicated on the vertical axis whereas, on the horizontal axis, the position angle in degrees of the element connected to the measuring device is indicated.

FIG. 3 shows the position-signal quantity characteristic of the two sensors 100 and 102 configured according to FIG. 2. In this connection, the characteristic 200 represents that of sensor 100 with the characteristic 200 falling from right to left and being essentially linear; whereas, the characteristic running in the opposite direction represents the characteristic 202 of sensor 102. These characteristic traces are a consequence of the different supply voltage circuitry of the two sensors. In addition, upper limit value 204 ($U_{G2}$) and lower limit value ($U_{G1}$) can be seen in FIG. 3 within which the signal quantities of the sensors must lie and a further threshold value line 208 ($U_{th}$) which respectively indicates when there is a drop below the region of idle and when the region close to idle is exceeded.

In addition, the minimum limit value 210 (Umin) is shown in the idle or near-idle region of the characteristic 202 of the sensor 102 serving to monitor the sensor 100. The limit value 210 (Umin) is generated by the circuit elements 130 and 138.

The subject matter illustrated above can be applied to check for malfunction as follows. A first malfunction check results from a comparison of the signal values with the upper and lower permissible limit values ($U_{G2}$, $U_{G1}$). This corresponds to a signal range check for each sensor individually. In addition, a check can be made as to whether the signal values referred to each other lie in a pregiven permissible tolerance band. This tolerance band can be formed in various ways. On the one hand, it is possible with sensors which move opposite to each other to carry out an addition of the signal quantities. Because of the electrically opposing operation, this leads to the signal quantity $U_{G2}$ forming the upper maximum limit value provided the sensors function correctly. A tolerance band is formed about the signal quantity $U_{G2}$ by the addition or subtraction of a value representing the deviation which is still tolerable between the sensor signal quantities and the sum of the signal quantities of the two sensors is checked with respect to maintaining this tolerance band.

On the other hand, this tolerance band can be formed by the addition and subtraction of a pregiven tolerance value to the signal values of the sensor 100 serving the control function. The signal value of the monitoring sensor 102 must then lie in this first tolerance band provided there is a fault-free function of the measuring device.

This measure can be used also for sensors running electrically in the same direction and for performance which runs in mutually opposite directions, the signal values must be converted for fault function checking.

In the idle or near-idle region, this first fault function check as to whether the signal quantities of the sensors with respect to each other lie outside of the first measuring range can cause an unnecessary switch-off of the overall system as a consequence of a detected fault function because of the possible occurrence of high transfer resistances. For this reason, in the idle or near-idle region, a second type of monitoring is introduced. This is comprised in that in this component region, a monitoring is undertaken which is less sensitive with respect to the tolerance band monitoring described above. For this purpose, the check is limited as to whether the signal values of the two sensors with respect to each other lie below the upper limit of the tolerance band.

A further plus with respect to reliability is obtained in this component region by the above-mentioned switching measures. A check of the signal value of sensor 102 with the pregiven minimal limit value Umin makes it possible to distinguish between an actual fault condition caused by a line interruption which must have a corresponding reaction as a consequence or an increased transfer resistance. The second value region is limited downwardly by Umin. An analog procedure can likewise be undertaken with respect to the sensor 100. However, in the embodiment, $U_{G1}$ is maintained as the lower limit.

This second type of monitoring or fault function check is less sensitive compared to the first.

The above-described procedure is then applied in another embodiment with only one sensor whose function is monitored by means of another, second operating parameter.

The program carried out in the computer unit 32 for fault function recognition of the measuring device 14 is shown in FIG. 4 as a flowchart. The program can also be applied in an analog manner to the measuring device 15.

After the start of the program part shown in FIG. 4, the two signal quantities determined via the lines 24 and 26 are read in in step 300. The signal quantities represent the position of the particular elements corresponding thereto. In step 302, the signal quantities are subjected to the inquiry as to whether one of the two signal quantities has exceeded an upper permissible limit value $U_{G2}$. If this is the case, a malfunction of the measuring device is recognized in step 304 the cause of which, for example, can be a short circuit to plus and possibly a provided emergency function can be introduced and the program part ended.

If both signal quantities are below their maximum permissible limit value $U_{G2}$, a check is made in inquiry step 306 as to whether both signal values are below a pregiven threshold $U_{th}$ which corresponds to an increased idle position. In dependence upon the result of inquiry step 306 and in case the two signal values do not lie below this threshold value, a first monitoring function is introduced and in the other case, a second monitoring function is introduced.

If the first-mentioned case occurs, then a check is made in inquiry step 308 as to whether one of the two signal quantities lies below a lower permissible limit value $U_{G1}$. If this is the case, then in step 310, a malfunction of the measuring device is detected based on a possible interruption in the positive supply voltage line, a short circuit to ground or an interruption of the signal lines and the program is ended. If both signal quantities lie above their lower permissible limit value $U_{G1}$ corresponding to the inquiry in step 308, then a check is made in the further steps as to whether both signal quantities with respect to each other lie in a pregiven signal range.

The check of the signal value of the sensor 100 serving the closed-loop control function can take place in advance of the inquiry 306 with, in the case of a fault of a drop below a minimum limit value $U_{G1}$, a fault reaction being introduced according to step 304. The inquiry 308 then refers only to the monitoring sensor 102.

In the inquiry step 312, the sum of the two signal values are investigated as to whether they lie above a tolerance range formed about the upper maximum limit value $U_{G2}$. If this is the case, then a move to step 310 takes place and a malfunction of the measuring device is detected and possibly an emergency function is initiated. This type of fault can arise as a consequence of shunts or non-linearities. If this is not the case, in the inquiry step 314, this sum is checked as to whether this sum lies below this tolerance band. If this is the case, the above-described reaction takes place according to step 310; whereas, in the other case, the operability of the measuring unit is determined and the system is driven in normal operation corresponding to step 316. Thereafter, the program part is ended and possibly started anew.

The steps 312 and 314 can be carried out such that one of the two signal values is checked as to whether it lies above or below a tolerance range formed about another signal value.

If in step 306, it is recognized that the signal quantities of the two sensors lie below the idle threshold, then in step 318 a check is made as to whether the signal value of the sensor 100 carrying out the closed-loop control function lies below the permissible minimal limit value $U_{G1}$.

If this is the case, a continuation according to step 304 takes place whereas, in the opposite case, in inquiry step 320, the signal value of the monitoring sensor 302 is checked with respect to whether the signal quantity generated thereby lies below the minimum limit value 210 Umin. With this kind of result, a conclusion is made as to an interruption of the signal line and/or an interruption of the positive supply voltage line of the sensor 302 and it is proceeded according to step 304. An opposite result of the inquiry step 320 leads to the inquiry according to step 322 as to whether the desired value generated by the operator element lies below an idle value increased by a tolerance value; that is, as to whether the measuring device is still disposed in the idle or near-idle region. If this is not the case, a malfunction check of the measuring device must be carried out according to the steps 312 and 314. If the desired value is however in the idle region, then the inquiry in step 324 is undertaken with which the check is made as to whether the signal value of the sensor 102 lies below the upper limit of the tolerance band formed about the signal value of the sensor 100. If the limit value is exceeded by the signal value, then this leads to a fault reaction pursuant to step 304, for example, because of a possible short circuit of the sensor 102 to plus; with the opposite result, it can, in contrast, be assumed that a normal operation of the measuring device takes place notwithstanding an increased transfer resistance, which could possibly be present between the slider tap and the resistance track.

With this second type of monitoring, a check is made as to whether the signal values of the sensors individually and/or with respect to each other lie outside of a second value range. Since this value range is in amount larger, the second type of monitoring is less sensitive than the first.

By means of the measures described above, a fault reaction can be avoided as a consequence of an adversely affected, incomplete signal transfer or signal generation.

We claim:

1. A system for controlling an internal combustion engine of a motor vehicle equipped with an actuator element influencing the output power of the engine and an operator-actuable element, each of said elements having a pregiven position range and a pregiven position subrange, the system comprising:

a measuring device for detecting the position of at least one of said elements and for providing a signal having a signal value indicative of said position within said position range and position subrange;

monitoring means for monitoring the operation of said measuring device based on said signal value;

said monitoring means including first comparator means for comparing said signal value to pregiven first and second limit values delimiting a first signal value range; and, detecting means for detecting a possible fault condition when the signal value passes out of said first signal value range by dropping below said first limit value or by exceeding said second limit value;

said monitoring means further including means for monitoring the operation of said measuring device with a lesser sensitivity when said one element is within said position subrange than when said one element is outside of said position subrange; and, said monitoring means including second comparator means for comparing said signal value to pregiven second limit values delimiting a second signal value range greater in magnitude than said first signal value range when said one element is operating in said position subrange so that a departure of said signal value from said first signal value range is permitted without a fault condition being detected.

2. The system of claim 1, wherein said second signal value range is limited by pregiven threshold values for the position of said element.

3. The system of claim 1, wherein said second signal value range is determined by an adversely affected and incomplete signal transmission.

4. The system of claim 1, wherein said measuring device includes a plurality of sensors for producing a plurality of signals having respective signal values indicative of the position of said one element.

5. The system of claim 4, said first comparator means being adapted to conjointly compare said signal values to said first and second limit values; said detecting means being adapted to detect a possible fault condition when said signal values pass out of said first value signal range; and, said second comparator means being adapted to conjointly compare said signal values to said second limit values when said one element is operating in said position subrange so that departures of said signal values from said first signal value range are permitted without a fault condition being detected.

6. The system of claim 4, wherein said second signal value range is limited by a lower limit value line derived from the signal magnitude of one of said sensors and by a lower predetermined limit line, which is less in amount than the lower limit line of the first signal value range.

7. The system of claim 6, wherein the lower limit line of the second signal value range is fixed by circuit means corresponding to the particular sensor.

8. The system of claim 7, wherein said circuit means defines resistors which form a voltage divider and with the aid of which a predetermined signal value can be impressed on the signal magnitude of the particular sensor.

9. The system of claim 5, wherein said second signal value range is near idle; and, the second signal value range borders on said first signal value range.

10. The system of claim 5, wherein said plurality of sensors are potentiometers.

11. A method for a system for controlling an internal combustion engine of a motor vehicle equipped with an actuator element influencing the output power of the engine and an operator-actuable element, each of said elements having a pregiven position range and a pregiven position subrange, said system including a measuring device for detecting the position of at least one of said elements, said measuring device including a plurality of sensors for producing a plurality of signals having respective signal values indicative of the position of said one element with one of said sensors being provided for monitoring the remainder of said plurality of said sensors, the method comprising the steps of:

initiating a possible fault reaction when one of said signal values exceeds an upper limit value of a first signal value range corresponding to said first position range;

checking to determine if all of said signal values are in a second signal value range corresponding to said position subrange;

initiating a fault reaction when said signal values are outside of said second signal value range and at least one of said signal values is below a lower limit value of said first signal value range; and, initiating a fault reaction when the signal values of the sensors are within said second signal value range and the signal value of said one sensor is below a predetermined lower limit value which is below the lower limit value of said first signal value range.

* * * * *